US010530076B2

(12) United States Patent
Behns et al.

(10) Patent No.: US 10,530,076 B2
(45) Date of Patent: Jan. 7, 2020

(54) CABLE LUG WITH DEFINED CRASH BEHAVIOR AND ARRANGEMENT OF A CABLE LUG

(71) Applicant: VOLKSWAGEN AKTIENGESELLSCHAFT, Wolfsburg (DE)

(72) Inventors: Patrick Behns, Rühen (DE); Jens Wolschner, Gifhorn (DE)

(73) Assignee: Volkswagen Aktiengesellschaft (DE)

( * ) Notice: Subject to any disclaimer, the term of this patent is extended or adjusted under 35 U.S.C. 154(b) by 0 days.

(21) Appl. No.: 16/352,898

(22) Filed: Mar. 14, 2019

(65) Prior Publication Data

US 2019/0288415 A1 Sep. 19, 2019

(30) Foreign Application Priority Data

Mar. 15, 2018 (DE) ..... 10 2018 203 922

(51) Int. Cl.
*H01R 11/12* (2006.01)
*H01R 4/18* (2006.01)
*H01R 11/26* (2006.01)

(52) U.S. Cl.
CPC ..... *H01R 11/12* (2013.01); *H01R 4/185* (2013.01); *H01R 11/26* (2013.01); *H01R 2201/26* (2013.01)

(58) Field of Classification Search
CPC ..... H01R 11/12; H01R 11/11; H01R 4/185; H01R 11/26; H01R 2201/26; H01R 4/34; Y10S 206/82
See application file for complete search history.

(56) References Cited

U.S. PATENT DOCUMENTS

| | | | | |
|---|---|---|---|---|
| 2,406,079 | A * | 8/1946 | Krueger | H01R 4/16 439/878 |
| 2,748,452 | A * | 6/1956 | Pierce | H01R 13/115 29/865 |
| 6,206,718 | B1 * | 3/2001 | Takahashi | H01R 4/308 439/382 |
| 6,783,377 | B2 * | 8/2004 | Aoyama | H01R 11/12 439/92 |
| 7,241,150 | B2 * | 7/2007 | Aihara | H01R 43/0256 439/83 |
| 8,202,102 | B2 * | 6/2012 | Kim | H01R 11/12 439/92 |
| 8,382,535 | B2 * | 2/2013 | Werthman | H01R 11/12 439/177 |
| 9,199,292 | B2 * | 12/2015 | Wunsch | B21D 5/00 |
| 9,318,819 | B2 * | 4/2016 | Backstrom | H01R 4/56 |
| 9,373,910 | B2 * | 6/2016 | Sato | H01R 43/005 |
| 9,559,443 | B2 * | 1/2017 | Boutin | H01R 11/11 |
| 2008/0182462 | A1 | 7/2008 | Werthman et al. | |

FOREIGN PATENT DOCUMENTS

| | | | |
|---|---|---|---|
| DE | 19602523 | C1 | 6/1997 |
| DE | 29806397 | U1 | 6/1998 |
| DE | 102008015553 | A1 | 10/2009 |
| DE | 112012003910 | T5 | 7/2014 |
| DE | 112014002495 | T5 | 3/2016 |
| JP | 2011049106 | A | 3/2011 |

* cited by examiner

*Primary Examiner* — Briggitte R. Hammond
(74) *Attorney, Agent, or Firm* — Barnes & Thornburg LLP

(57) ABSTRACT

A cable shoe having a predetermined breaking location and an arrangement of a cable shoe connected to a cable-shoe end of a cable.

8 Claims, 4 Drawing Sheets

CABLE LUG WITH DEFINED CRASH BEHAVIOR AND ARRANGEMENT OF A CABLE LUG

PRIORITY CLAIM

This patent application claims priority to German Patent Application No. 10 2018 203 922.4, filed 15 Mar. 2018, the disclosure of which is incorporated herein by reference in its entirety.

SUMMARY

Illustrative embodiments relate to a cable shoe and to an arrangement of a cable shoe.

BRIEF DESCRIPTION OF THE DRAWINGS

The disclosed embodiments will be explained hereinbelow with reference to the associated drawings, in which.

DETAILED DESCRIPTION

Figure 1A:
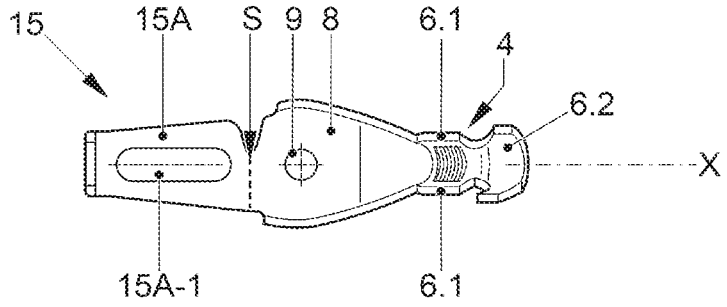
FIG. 1A shows a cable shoe in a view from beneath.
Figure 1B:
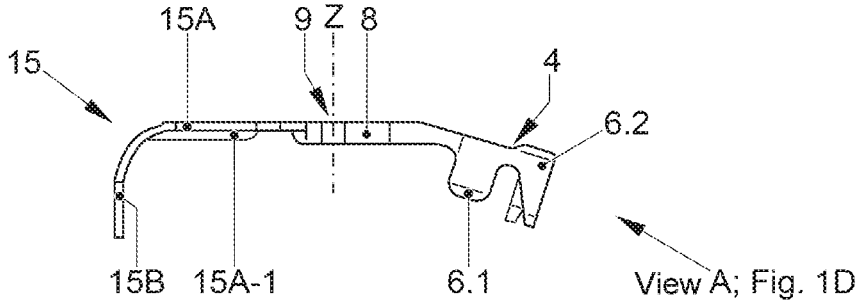
FIG. 1B shows the cable shoe in a side view.

DE 298 06 397 U1 relates to a cable shoe which is made from a punched sheet-metal part and has, at one end, a cable-connection region and, at the other end, a fastening eye, which has a fastening hole and forms a contact region, and a transition region between the cable-connection region and contact region. It is an interesting point here that the punched sheet-metal part has a punched edge, wherein components of the cable shoe are attached to the cable shoe by way of a small undercut recess introduced into the punched edge, this making it easier for the components—referred to as lugs—to be bent.

DE 196 02 523 C1 discloses a typical cable shoe with a screw connection, the cable shoe being bent in one piece from a punched sheet-metal part and having a U-shaped retaining element and a flat fastening part, which forms a perforated eye, wherein the screw connection acts on the perforation. In the use position, a nut rests on the eye and ensures fastening on a contact part.

DE 10 2008 015 553 A1 explains a fork-form cable shoe having an essentially flat connection head and having two limbs, wherein at least one of the two limbs has a cutout and/or a latching-in element for arrangement on a terminal board.

The disclosed embodiments provide a cable shoe which, in its use position, has a function which increases the functional reliability of the cable shoe, in particular, in the event of a crash.

The departure point of the disclosed embodiments is a conventional cable shoe.

According to the disclosed embodiments, provision is made for the cable shoe to have a predetermined breaking location. The arrangement of a predetermined breaking location in a cable shoe is not known to the applicant from the prior art. In addition, the arrangement of a predetermined breaking location does not appear to be beneficial, but the following description will explain that the arrangement of a predetermined breaking location has beneficial effects, without the conventional function of the cable shoe being adversely affected. The basic idea is that the arrangement or introduction of a predetermined breaking location in the cable shoe does not in any way restrict the way in which the cable shoe has been previously used, but, in certain cases during use, in particular, in the event of a crash, the predetermined breaking location creates an additional cable-shoe function, which significantly increases the use value of the disclosed cable shoe in relation to the conventional cable shoe, since the additional function also takes effect when use is made of the disclosed cable shoe in a scenario which has not been considered up until now, in particular, in the event of a crash, as is yet to be explained in detail hereinbelow.

Provision is made for the predetermined breaking location to be designed as a cutout and/or material weakening. The arrangement of cutouts and/or material weakenings can be realized in a straightforward and effective manner.

Provision is also made such that, as seen in relation to a longitudinal extent along a longitudinal axis of the cable shoe, the predetermined breaking location is arranged between a rotation-prevention element and a fastening element. On the one side of the predetermined breaking location as seen over the longitudinal extent along the longitudinal axis of the cable shoe, the cable shoe may have a material-stabilizing element, in particular, a bead, in the rotation-prevention element, in the vicinity of the predetermined breaking location, provision additionally being made such that, on the other side of the predetermined breaking location as seen over the longitudinal extent along the longitudinal axis of the cable shoe, a fastening connection is arranged in the fastening element, in the vicinity of the predetermined breaking location. Consideration as to where to position the predetermined breaking location has resulted in a cable-shoe region which can be straightforwardly rendered stable on either side of the predetermined breaking location to the extent where the predetermined breaking location, which is arranged between the material-stabilizing element and the fastening connection, takes effect, in a reliable and reproducible manner, as a deformation location or breaking location in the event of a crash.

Provision is made for a predetermined breaking line of the predetermined breaking location to run along an axis which is arranged transversely to the longitudinal axis of the cable shoe. This arrangement or orientation of the predetermined breaking line in relation to the longitudinal axis of the cable shoe results from the geometry of the forces which act on the cable shoe in the event of a crash, as will be explained in more detail hereinbelow.

Provision is made for the cutout of the predetermined breaking location to be designed as a groove, in particular, as a v-shaped groove. Provision is also made for the groove to merge into the predetermined breaking line of the predetermined breaking location in alignment with the axis. The benefit of such a configuration will be explained in more detail hereinbelow.

The disclosed embodiments also relate to the arrangement of a cable shoe which, in the assembled state, is connected to a cable-shoe end of a cable and, in a use position, is arranged on a contact part, such that rotation is prevented in relation to an axis, by a fastening connection, wherein the axis runs transversely to a longitudinal axis of the cable shoe.

According to the disclosed embodiments, provision is made for the other cable end, which is located opposite the cable-shoe end, to be connected to another part, in particular, a transportation vehicle body, at a point of connection, wherein, based on a predeterminable length of cable present, a movement of the contact part and of the other part relative to one another results, via the cable-shoe end, in the disclosed cable shoe being subjected to a tensile force of the cable, wherein the tensile force is exerted on that end of the cable shoe at which the cable-shoe end of the cable is connected to the cable shoe. The cable shoe has the predetermined breaking location according to the disclosed embodiments, which is arranged between the rotation-prevention element and the fastening element. In the normal use position of the cable shoe, the fastening element of the cable shoe is fastened on the contact part by the fastening connection and, in the normal use position of the cable shoe, the rotation-prevention element of the cable shoe engages in a depression of the contact part such that rotation is prevented. In the event of a crash, the predetermined breaking location, which has been explained above, allows the cable shoe, and also the cable connected to the cable shoe, to rotate about the axis of the fastening connection described, despite the rotation-prevention means being present in the use position, about the axis of the fastening connection described. In other words, in normal use other than in the event of a crash, the rotation-prevention method or mechanism is active, as will be explained in yet more detail hereinbelow. In the event of a crash, however, the rotation-prevention method or mechanism becomes inactive, since a crash causes the deformation, which will be explained in more detail hereinbelow, of the breakage of the cable shoe between the rotation-prevention element and the fastening element of the cable shoe, wherein lies a significant benefit of the present disclosure.

FIGS. 1A to 1E and 3 give an overall view of the cable shoe 1, the construction of which will be explained hereinbelow. The arrangement of the cable shoe 1 is shown, by way of example, in an engine compartment 10 of a transportation vehicle (not illustrated in any more detail) in FIG. 2.

Figure 1C:
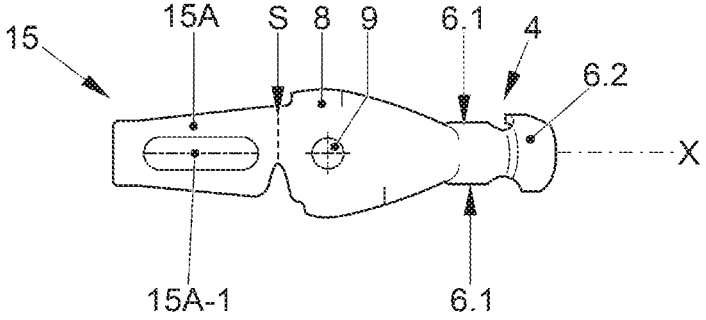
FIG. 1C shows the cable shoe in a plan view.
Figure 1D:
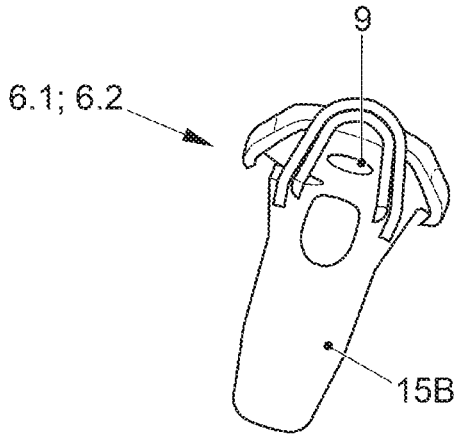
FIG. 1D shows the cable shoe in a view A according to FIG. 1B.
Figure 1E:
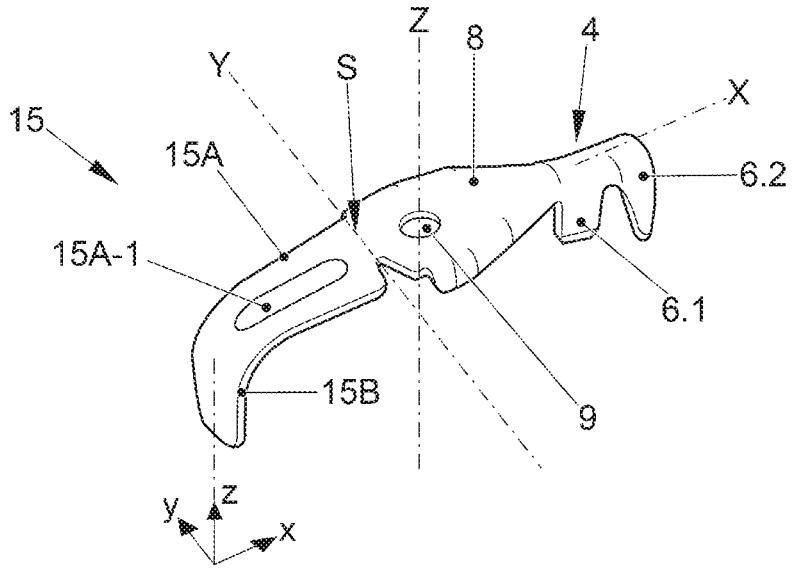
FIG. 1E shows a perspective plan view of the cable shoe as seen obliquely from above.

The cable shoe 1 has a longitudinal axis X, which is indicated in FIGS. 1A, 1C and 1E. The central element of the cable shoe 1 is a fastening element 8. An opening 9, in particular, a circular opening, perforated eye is arranged in the flat, or planar, fastening element 8.

In the use position (cf. FIG. 2) of the cable shoe 1, the fastening element 8 establishes contact, by a fastening connection 3, in particular, of a screw connection, passing through the opening 9, with a mating contact 21 (cf. FIG. 2) of a contact part 20, wherein, in the exemplary embodiment illustrated, a screw connection 3 comprises a bolt 11 and a nut 12 (illustrated only in FIG. 2), which encompasses the bolt and engages over the eye. However, it would also be conceivable to have a screw which has its head passing through the fastening element 8, that is to say the eye 9.

Figure 2:
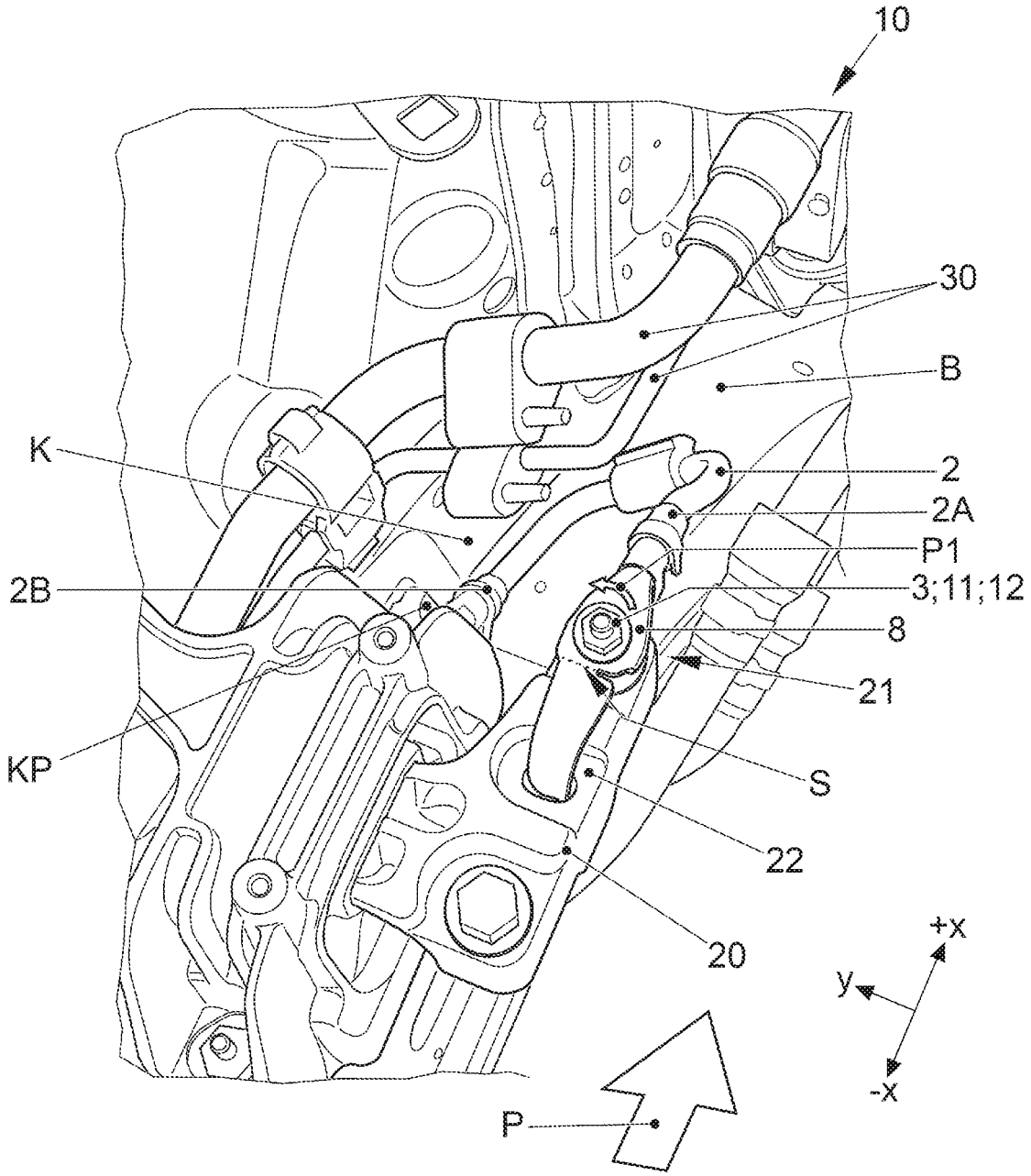
FIG. 2 shows an arrangement of the cable shoe in an engine compartment of a transportation vehicle.

In the use position (cf. FIG. 2), the bolt 11 (as illustrated in FIG. 2) or the screw is fixed to the contact part 20.

In the exemplary embodiment, the contact part 20 is an engine bearing, wherein, for reasons of clarity, the engine has not been illustrated.

On its one longitudinal side, the cable shoe 1 comprises a rotation-prevention element 15, which is designed as an angled portion, wherein the angled portion is of essentially orthogonal design. A first limb 15A is located in the x/y plane (cf. FIG. 1E) of the fastening element 8 and a second, orthogonally angled limb 15B is located in a y/z plane, which runs orthogonally to the x/y plane.

A stabilizing element 15A-1, which is designed as a bead, is formed in the surface of the first limb 15A. The stabilizing element 15A-1 ensures that, when the cable shoe 1 is subjected to the action of force where a force F (cf. FIG. 3) acts on the first limb 15A, tearing or buckling of the first limb 15A is, for the most part, prevented.

In the use position (cf. FIG. 2), the end of the second, orthogonally angled limb 15B is supported in/on the contact part 20, wherein, in the exemplary embodiment, the contact part 20 contains a depression 22, in which the end of the second, orthogonally angled limb 15B engages such that, in the use position of the cable shoe 1, the longitudinal axis X of the cable shoe 1 is prevented from rotating about the vertical axis Z (cf. FIG. 1E) of the screw connection 3.

On its other longitudinal side, which is located opposite the longitudinal side of the rotation-prevention element 15, the cable shoe 1 comprises a retaining element 4. In the exemplary embodiment, the cable shoe 1 comprises a retaining element 4 which has been pre-bent twice to form a U shape and has two accommodating method or mechanism, wherein, in the assembled state, a first accommodating element accommodates the conductive end of a cable 2 (cf. FIG. 2) with clamping action as a result of the U cross section of the U limbs 6.1 being pushed together. It is known that the U limbs 6 here are adapted to the usually round cross-sectional shape of the cable 2 and of the conductive end thereof. The retaining element 4 comprises the further U limb 6.2, and thus a further, second accommodating element which, in the assembled state, engages around an insulated region of the cable 2, wherein this additional, second accommodating element 6.2 is not absolutely necessary, but is usually provided for stability reasons.

Before further features which are essential to the disclosure are described, the arrangement of the cable 2 will be explained in respect of the function according to the disclosure.

In the exemplary embodiment, the cable 2 is a ground cable which, as already explained, at one end (cf. FIG. 2), has a first end 2A connected in a fixed position to the cable shoe 1 and, at the other end, has a second end 2B (cf. FIG. 2) connected in a fixed position to an electrically conductive element, in particular, the body K of a transportation vehicle.

The cable 2 has its body end 2B connected in a fixed position to the body K at a point of attachment KP and in an attachment element, which will not be explained in any more detail.

The point of attachment KP here is located in a plane which is located beneath a plane of the contact part 20 (cf. FIG. 2), in particular, of the engine bearing 20.

FIG. 2 illustrates an arrow P which identifies the crash-induced direction of force on a front part of a transportation vehicle. Such a crash usually takes place in a plane in which the crash-induced force acts on the engine 21, and therefore on the engine bearing 20.

In the case of the cable 2 being arranged, as described and shown in FIG. 2, as a ground lead on the engine bearing 20 and at the point of attachment KP to the transportation vehicle body, the cable 2 is located within the engine compartment, relatively close to a further component of the transportation vehicle, wherein, in the exemplary embodiment, the further component is constituted by supply lines 30 of an air-conditioning system (not illustrated in any more detail). In the event of a crash, the intention is to avoid the situation, when the engine bearing 20 moves in the direction of the arrow P along the x axis in the +x direction, where the cable 2 collides with the supply lines 30 of the air-conditioning system.

FIG. 2 also illustrates an installation space B, in which further components are arranged within the engine compartment, for example, a brake booster or at least one other subassembly being arranged in the installation space B. It is also the case with this installation space, which is therefore not available as a yielding-movement alternative in the event of a crash, that the intention is to avoid the situation, when the engine bearing 20 moves in the direction of the arrow P along the x axis in the +x direction, where the cable 2 collides with another subassembly.

However, the movement of the engine, in particular, of the engine bearing 20, which takes place in the +x direction in the event of a crash constitutes an admissible penetrating movement which cannot, or should not, be prevented.

In this respect, a different solution is created to prevent such possible collisions of the cable 2 with components located in its vicinity.

As explained, in the use position, the cable shoe 1 has a rotation-prevention method or mechanism provided by the rotation-prevention element 15, it being ensured here, at the same time, that the cable shoe 1 is always installed correctly, as is illustrated in FIG. 2, by any worker.

As a result, the cable shoe 1 is retained in a defined position in the event of a crash. In other words, as a result of being arranged in the correct position by the rotation-prevention element 15, the cable shoe 1 follows a penetrating movement of the engine bearing 20 in the +x direction in the event of a crash. This movement should nevertheless be avoided, since the cable 2 is thus inevitably pushed in an undesirable direction.

To prevent this movement of the cable 2, it has been found, in the first instance, that the point of attachment KP of the cable 2 to the transportation vehicle body allows only a slight yielding movement of the cable 2, since the point of attachment KP of the cable 2 to the transportation vehicle body restrains the cable 2 in the event of a crash. However, there is a risk here of the cable 2, designed as a ground lead, tearing, as a result of which it is no longer possible to maintain electrical functions in the event of a crash, possibly on account of the absence of a ground connection.

For this reason, the disclosed embodiments propose providing, at a defined location of the cable shoe 1, a predetermined breaking location S (cf. FIGS. 1A to 1E and FIG. 2), which, based on the effective force, allows rotation of the cable shoe 1 about the Z axis, as will be explained hereinbelow with reference to FIGS. 1A to 1E and FIG. 2, and, in particular, with reference to the enlarged illustration of the predetermined breaking location S of the cable shoe 1 according to FIG. 3, using the same reference signs.

Figure 3:
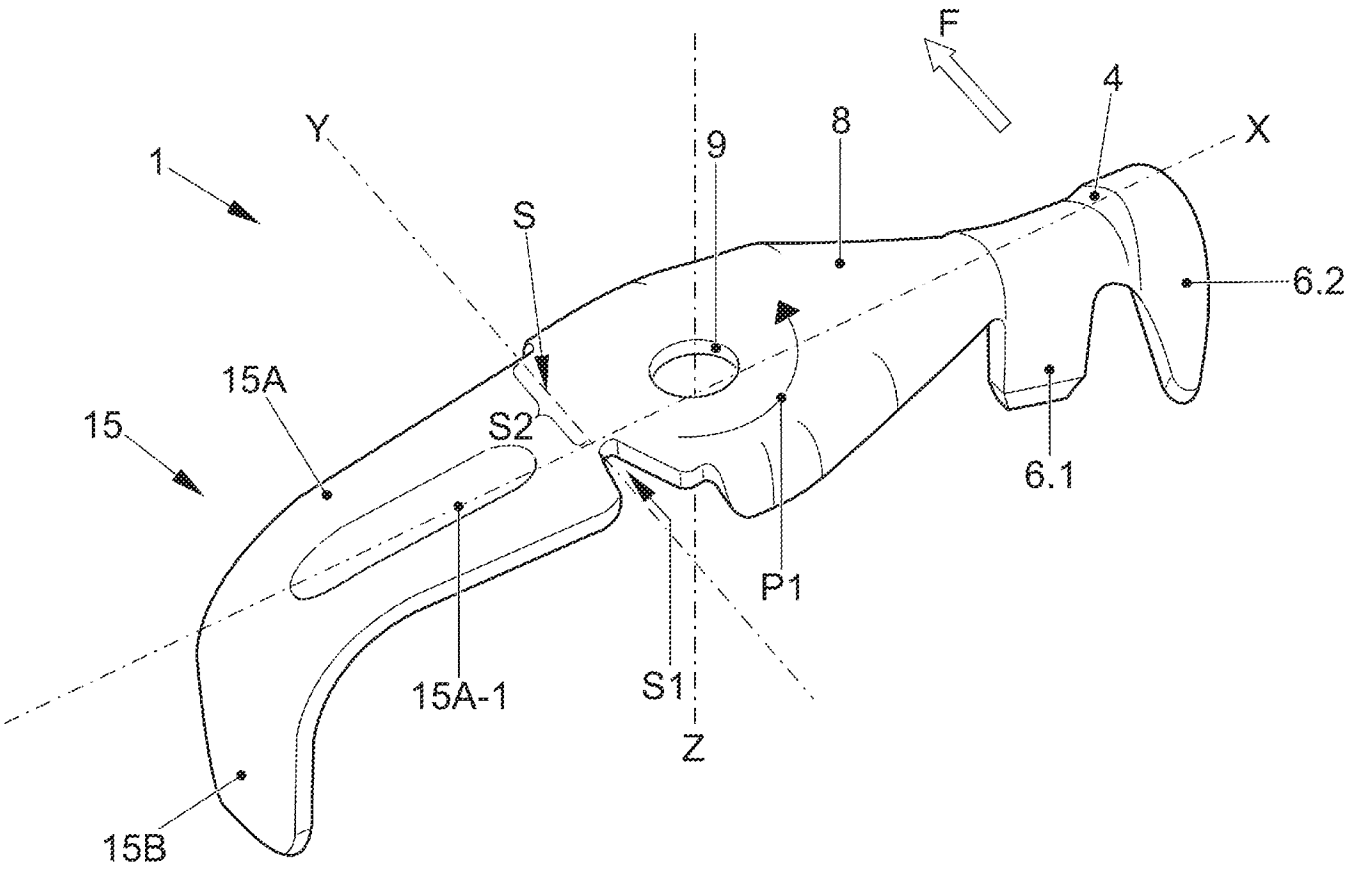
FIG. 3 shows an enlarged perspective illustration of the cable shoe for the purpose of clarifying a predetermined breaking location of the cable shoe.

As FIG. 3 clarifies, the predetermined breaking location S is formed between the rotation-prevention element 15 and the fastening element 8. According to the disclosed embodiments, the predetermined breaking line Y of the predetermined breaking location S runs orthogonally to the longitudinal axis X of the cable shoe 1.

According to the disclosed embodiments, the predetermined breaking location S is arranged at the position shown in the figures, wherein the selection of this position will be discussed in more detail hereinbelow.

The predetermined breaking location S is designed as a cutout S1 and/or as a material weakening S2, wherein, in the present exemplary embodiment, a combination of a cutout S1 and material weakening S2 will be explained.

It is generally possible, which fact is being explicitly pointed out once again, that the predetermined breaking location S can also be formed by the material weakening S2 or the cutout S1.

The disclosure ensures, in principle, that the aforementioned measures (cutout S1 and/or material weakening S2) mean that, in the event of a crash, in particular, during a relative movement of the transportation vehicle body K opposite contact part 20 or vice versa, at least one defined deformation of the cable shoe 1 takes place in the region of the predetermined breaking location S, or even tearing of the rotation-prevention element 15 from the fastening element 8 takes place in the region of the predetermined breaking location S, based on the effective force, as will be explained hereinbelow.

To provide for the desired function, it is ensured that the length of cable 2 retained between the point of attachment KP to the transportation vehicle body K and the cable shoe 1 is such that, during the already explained relative movement of the contact part 20, in particular, of the engine bearing, in accordance with the arrow P into the engine compartment, starting from the point of attachment KP of the cable, the retaining element 4 of the cable shoe 1 is subjected to a tensile force F (cf. FIG. 3) which is induced laterally, as seen in relation to the longitudinal axis X of the cable shoe 1, and therefore the cable shoe 1 is subjected to tensile stressing laterally in accordance with the arrows P1 illustrated in FIGS. 2 and 3, as a result of which the retaining element 4 and the fastening element 8 and the rotation-prevention element 15 are prompted to rotate about the Z axis in relation to the bolt 11.

However, based on the effective force, rotation is prevented by the contact-pressure force of the screw connection A3 on the contact part 20 and by the rotation prevention in relation to the contact part 20 produced by the rotation-prevention element 15.

However, when a predetermined magnitude of the active tensile force F which causes the rotation of the cable shoe 1—with the tightening moment of the nut 12 of the screw connection 3 on the contact part 12 being partially overcome in the process—about the Z axis in relation to the bolt 11 is exceeded, the cable shoe 1 is deformed in a defined manner in the region of the predetermined breaking location S, or even the rotation-prevention element 15 tears off from the fastening element 8 in the region of the predetermined breaking location S.

More attention given here to the bead 15A-1, of which the significance in respect of the desired defined deformation of the predetermined breaking location S now becomes even clearer, since the bead 15A-1 stabilizes the rotation-prevention element 15 to the extent where the deformation takes place in the region of the predetermined breaking location S. The bead 15A-1 thus avoids the deformation taking place in the region of the first limb 15A.

It also becomes clear here that the effect of selecting the position of the predetermined breaking location S is that the defined deformation of the cable shoe 1 in the region of the predetermined breaking location S, or the tearing off of the rotation-prevention element 15 from the fastening element 8 in the region of the predetermined breaking location S, the cable 2 always remains connected to the contact part 20 via the screw connection 3, and therefore the functions which the cable 2 is intended to perform are maintained in the event of a crash. In other words, the disclosed cable shoe 1 preserves its original function and now has a further function, which is that of avoiding a collision between the cable 2 and other nearby components which surround the cable 2.

The cutout S1 and/or the material weakening S2 can be designed in different ways.

In the present exemplary embodiment, which explains the combination of measures S1 and S2, the predetermined breaking location S is designed, as far as the cutout S1 is concerned, as a v-shaped groove, which is arranged on that flank of the cable shoe 1 which is subjected to the highest deformation force in the event of a crash. The cutout S1 designed as a v-shaped groove thus predefines the deformation location or the breaking location, and therefore, in the event of a crash, the cable shoe 1 is deformed or broken at the desired predetermined breaking location S. The valley of the v-shaped groove merges into the reduced-material predetermined breaking line of the predetermined breaking location S in alignment along the Y axis. It goes without saying that this exemplary embodiment should not include the predetermined breaking location S being designed such that corresponding cutouts S1 can be arranged possibly on both flanks of the cable shoe 1. A material weakening of the predetermined breaking location S can be formed on the underside or the upper side, wherein material weakening also means, for example, a perforation of the predetermined breaking line of the predetermined breaking location S.

LIST OF REFERENCE SIGNS

1 Cable shoe
2 Cable
2A First end
2B Second end
3 Fastening connection, screw connection
4 Retaining element
6.1 First accommodating element
6.2 Second accommodating element
8 Fastening element
9 Opening
10 Engine compartment
21 Mating contact
11 Bolt
12 Nut
15 Rotation-prevention element
15A First limb
15B Second limb
15A-1 Stabilizing element
20 Contact part, engine bearing
21 Engine
22 Depression
30 Supply lines
K Transportation vehicle body
KP Point of attachment
P Arrow
P1 Arrow
B Installation space
S Predetermined breaking location
S1 Cutout
S2 Material weakening
F Force, tensile force
X X axis over the longitudinal extent of the cable shoe 1
Z Z axis over the longitudinal extent of the fastening connection 3
Y Y axis over the longitudinal extent of a predetermined breaking line of the predetermined breaking location S
K Transportation vehicle body
−x Direction of the usual direction of travel of a transportation vehicle
+x Direction counter to the usual direction of travel of the transportation vehicle
y Direction in the horizontal transverse to the x direction of the transportation vehicle

The invention claimed is:

1. An arrangement comprising:

a cable shoe connected to a cable-shoe end of a cable in an assembled state and arranged on a contact part in a use position, so rotation is prevented in relation to a Z axis by a fastening connection, wherein the Z axis runs transversely to a longitudinal axis of the cable shoe, wherein other end of the cable is connected to another part at a point of attachment, wherein the cable shoe defines a predetermined breaking location arranged between a rotation-prevention element and a fastening element, wherein the fastening element of the cable shoe is fastened on the contact part by the fastening connection in the use position of the cable shoe and the rotation-prevention element of the cable shoe engages in a depression of the contact part to prevent rotation of the cable shoe arranged in the use position such that application of a tensile force of the cable via the cable shoe end along a length of the cable resulting from a movement of the contact part and of the other another part relative to one another, causes the cable shoe to break along the predetermined breaking location, and wherein the tensile force is exerted on that end of the cable shoe at which the cable-shoe end of the cable is connected to the cable shoe.

2. A cable shoe comprising:

a rotation-prevention element and a fastening element joined to the rotation-prevention element, wherein the cable shoe defines a predetermined breaking location arranged between the rotation-prevention element and the fastening element, wherein the fastening element of the cable shoe is fastened on a contact part when the cable shoe is in a use position, and the rotation-prevention element of the cable shoe engages in a depression of the contact part to prevent rotation of the cable shoe arranged in the use position such that application of a tensile force along a cable attached to the rotation-prevention element of the cable shoe causes the cable shoe to break along the predetermined breaking location, wherein the cable is connected to the cable shoe at a first cable end and connected to another part at a second cable end, wherein the tensile force results from a movement of the contact part and of the another part relative to one another, and wherein the tensile force is exerted along a length of the cable.

3. The cable shoe of claim 2, wherein the predetermined breaking location is a cutout and/or material weakening.

4. The cable shoe of claim 2, wherein the predetermined breaking location is arranged between the rotation-prevention element and the fastening element along a longitudinal axis extending along a length of the cable shoe.

5. The cable shoe of claim 4, wherein a material-stabilizing element is formed about a first end of the rotation-prevention element along the longitudinal axis, the first end being disposed opposite a second end of the rotation-prevention element and the second end being proximate to the predetermined breaking location, and wherein a fastening connection is provided in the fastening element.

6. The cable shoe of claim 2, wherein a predetermined breaking line of the predetermined breaking location runs along a Y axis, which is arranged transversely to the longitudinal axis of the cable shoe.

7. The cable shoe of claim 6, wherein the cutout of the predetermined breaking location is a groove, and the groove merges into the predetermined breaking line of the predetermined breaking location in alignment with the Y axis.

8. The cable shoe of claim 3, wherein the cutout of the predetermined breaking location is a groove.

* * * * *